US005931289A

United States Patent [19]

Chou

[11] Patent Number: 5,931,289

[45] Date of Patent: Aug. 3, 1999

[54] CIRCUIT BREAKER WITH QUICK CLOSING MECHANISM

[75] Inventor: Yu Wei Chou, Moontownship, Pa.

[73] Assignee: Eaton Corporation, Cleveland, Ohio

[21] Appl. No.: 09/037,688

[22] Filed: Mar. 10, 1998

[51] Int. Cl.[6] ..... H01H 77/02

[52] U.S. Cl. ..... 200/288; 200/319; 200/325; 335/171

[58] Field of Search ..... 200/319, 325, 200/327, 288, 425, 401; 335/46, 104, 171

[56] References Cited

U.S. PATENT DOCUMENTS

| | | | |
|---|---|---|---|
| 3,110,792 | 11/1963 | Gauthier | 200/319 |
| 3,134,879 | 5/1964 | Gauthier et al. | 200/325 X |
| 3,739,127 | 6/1973 | Long et al. | 200/288 X |
| 4,540,961 | 9/1985 | Maier | 335/16 |

*Primary Examiner*—Renee S. Luebke

*Attorney, Agent, or Firm*—Martin J. Moran

[57] ABSTRACT

A circuit breaker includes a releasable retaining mechanism for releasably retaining a movable contact arm of the circuit breaker to prevent "sneak" during movement of the contact arm to the closed position, as well as, to prevent "bounce" during movement of the contact arm to the open position. The releasable retaining mechanism preferably includes a hook member rigidly secured to the movable contact arm and a retaining spring secured to the operating mechanism of the circuit breaker. The hook member engages the retaining spring when the movable contact arm is in the open position. The releasable retaining mechanism further includes a release finger extending from the operating mechanism adjacent the retaining spring, the release finger being positioned to contact the retaining spring when an operating handle of the circuit breaker is moved to actuate the operating mechanism in order to place the movable contact arm in a closed position. This results in the hook member being released from engagement with the retaining spring, allowing the movable contact arm to be rapidly rotated to the closed position.

8 Claims, 6 Drawing Sheets

CIRCUIT BREAKER WITH QUICK CLOSING MECHANISM

BACKGROUND OF THE INVENTION

Field of the Invention

The present invention relates generally to circuit breakers having an actuatable operating mechanism for moving a contact arm between a closed and open position, and more particularly, to a circuit breaker having a releasable retaining mechanism for rapidly effecting movement of the contact arm to the closed position.

Background Information

Circuit breakers have separable contacts which include a fixed contact and a movable contact mounted on a movable contact arm. The movable contact arm is rotated by an operating mechanism between a closed position in which the movable contact engages the fixed contact, and an open position in which the contacts are separated to interrupt current flow. Typically the operating mechanism is spring powered to rapidly open the contacts in response to an overload condition. In addition, an operating handle is provided for actuating the operating mechanism by taking advantage of the spring power to also rapidly close the contacts to initiate current flow. An example of a circuit breaker having the described separable contacts, operating mechanism and operating handle is set forth in U.S. Pat. No. 4,540,961.

If the operating handle is operated too slowly when attempting to close the contacts, a problem commonly identified in the art as "sneak" may occur. Sneak results from insufficient force being built up and stored in the spring when the operating handle is operated too slowly. This in turn prevents the movable contact arm from being rotated rapidly enough to close the contacts, which may be necessary to, for example, overcome repulsion forces or prevent arcing when attempting to close on a current.

One solution to the sneak problem is to increase the spring force in the operating mechanism, which is typically accomplished by using a larger spring. However, due to limited space within the circuit breaker, this is not always a viable solution. Another solution to the sneak problem is to apply a lubricant which will reduce friction and overcome resistance within the operating mechanism. However, application of the lubricant to the operating mechanism is difficult once the circuit breaker is assembled and installed for operation.

Another problem commonly associated with circuit breakers of the type described is "bounce". Bounce may occur as a result of rapid rotation of the movable contact arm during rapid opening of the contacts. Bounce may occur during either an automatic tripping operation or when manually maneuvering the operating handle to open the contacts. Typically, the movable contact arm engages a stop once in the fully open position and as a result of the rapid rotation thereof, the movable contact arm may bounce off of the stop and rotate back towards the fixed contact. This increases the possibility of arcing, or even reestablishing current flow through the contacts. To prevent bounce from occurring, various solutions have been suggested, such as, for example, providing the stop with a resilient, shock absorbing material. However, such solutions have not proven to be entirely effective and a new more effective solution is desirable.

There is a need, therefore, for a circuit breaker having a mechanism which prevents sneak from occurring during movement of the contact arm to the closed position.

There is an additional need for such a circuit breaker having a mechanism which prevents bounce from occurring during movement of the contact arm to the open position.

There is a still further need for such a circuit breaker that can be economically produced and in which the mechanism for preventing sneak and/or bounce may be incorporated into existing circuit breaker designs.

SUMMARY OF THE INVENTION

These needs and others are satisfied by the invention which is directed to a circuit breaker having a releasable retaining means for releasably retaining a movable contact arm of the circuit breaker to prevent sneak during movement of the contact arm to the closed position, as well as, to prevent bounce during movement of the contact arm to the open position.

In a preferred embodiment, the releasable retaining means includes a hook member rigidly secured to the movable contact arm and a retaining spring mounted or secured to the operating mechanism of the circuit breaker. The hook member engages the retaining spring when the movable contact arm is in the open position. The releasable retaining means further includes a release finger extending from the operating mechanism adjacent the retaining spring. The release finger is positioned to contact the retaining spring when an operating handle of the circuit breaker is moved to actuate the operating mechanism in order to place the movable contact arm in the closed position. Advantageously, this releases the hook member from engagement with the retaining spring allowing for the movable contact arm to be placed in the closed position.

As is known, the operating mechanism may include an over-center toggle mechanism having an operating tension spring. When the operating handle is actuating the operating mechanism in order to place the movable contact arm in the closed position, the operating tension spring builds up and stores energy as it moves from a first line of action (open position) to a second line of action (closed position). In accordance with an important aspect of the present invention, the release finger contacts the retaining spring once the operating tension spring approaches the second line of action resulting in the energy stored in the spring being released to quickly or rapidly close the contact arm. This effectively prevents sneak from occurring within the circuit breaker by allowing for sufficient energy to be built up in the operating tension spring prior to the release finger contacting the retaining spring and releasing the movable contact arm from engagement therewith.

As can be appreciated, bounce is also prevented from occurring during movement of the movable contact arm to the open position as a result of the hook member positively engaging the retaining spring once the movable contact arm reaches the open position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

The invention will be described as applied to a molded case circuit breaker of the type described in U.S. Pat. No. 4,540,961, the disclosure of which is hereby incorporated by reference.

Figure 1:
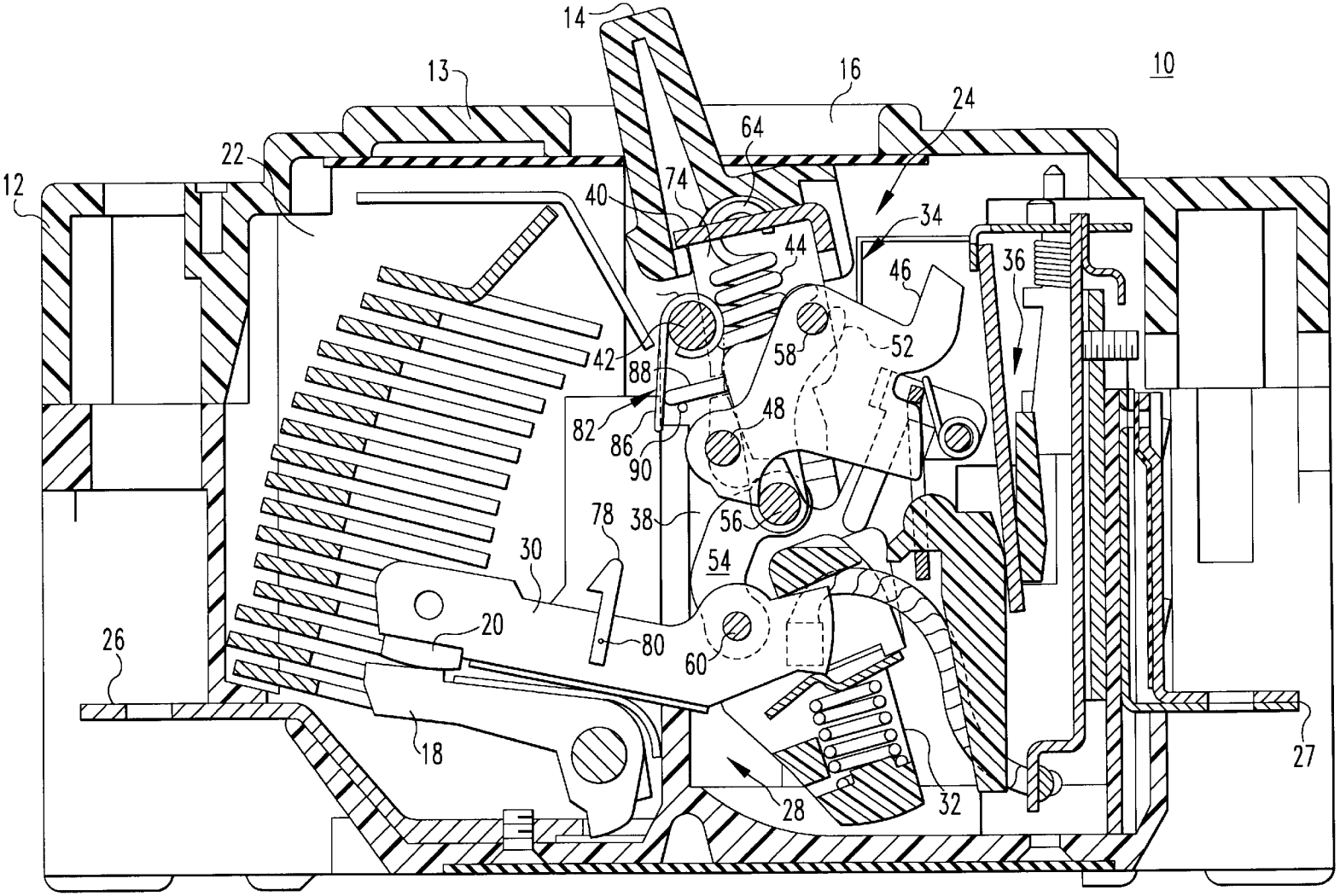
FIG. 1 is a sectional view through a center pole of a circuit breaker incorporating the invention, the circuit breaker being shown in the closed or on position.
Figure 2:
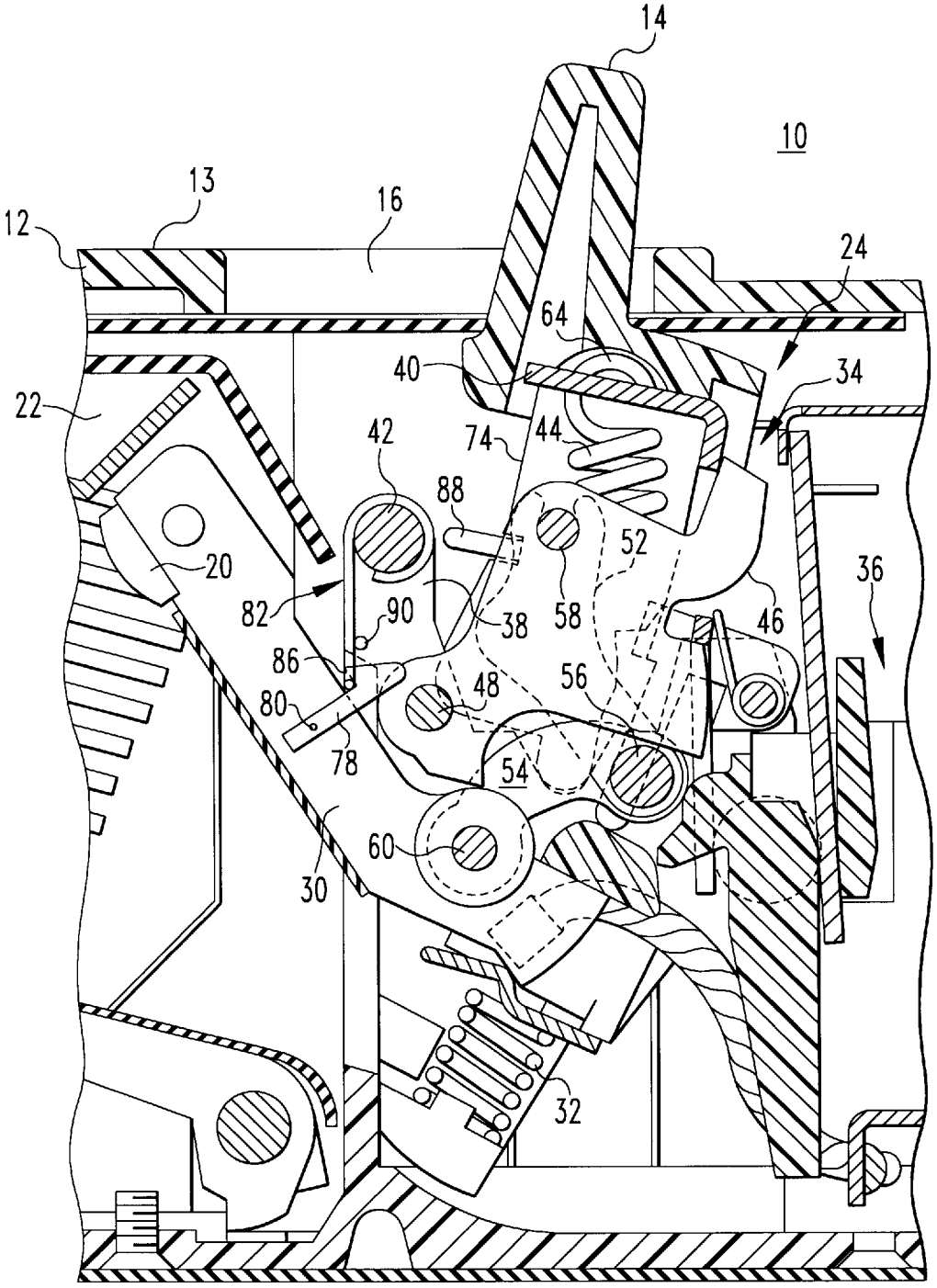
FIG. 2 is a partial sectional view similar to FIG. 1 showing the circuit breaker in the open or off position.
Figure 3:
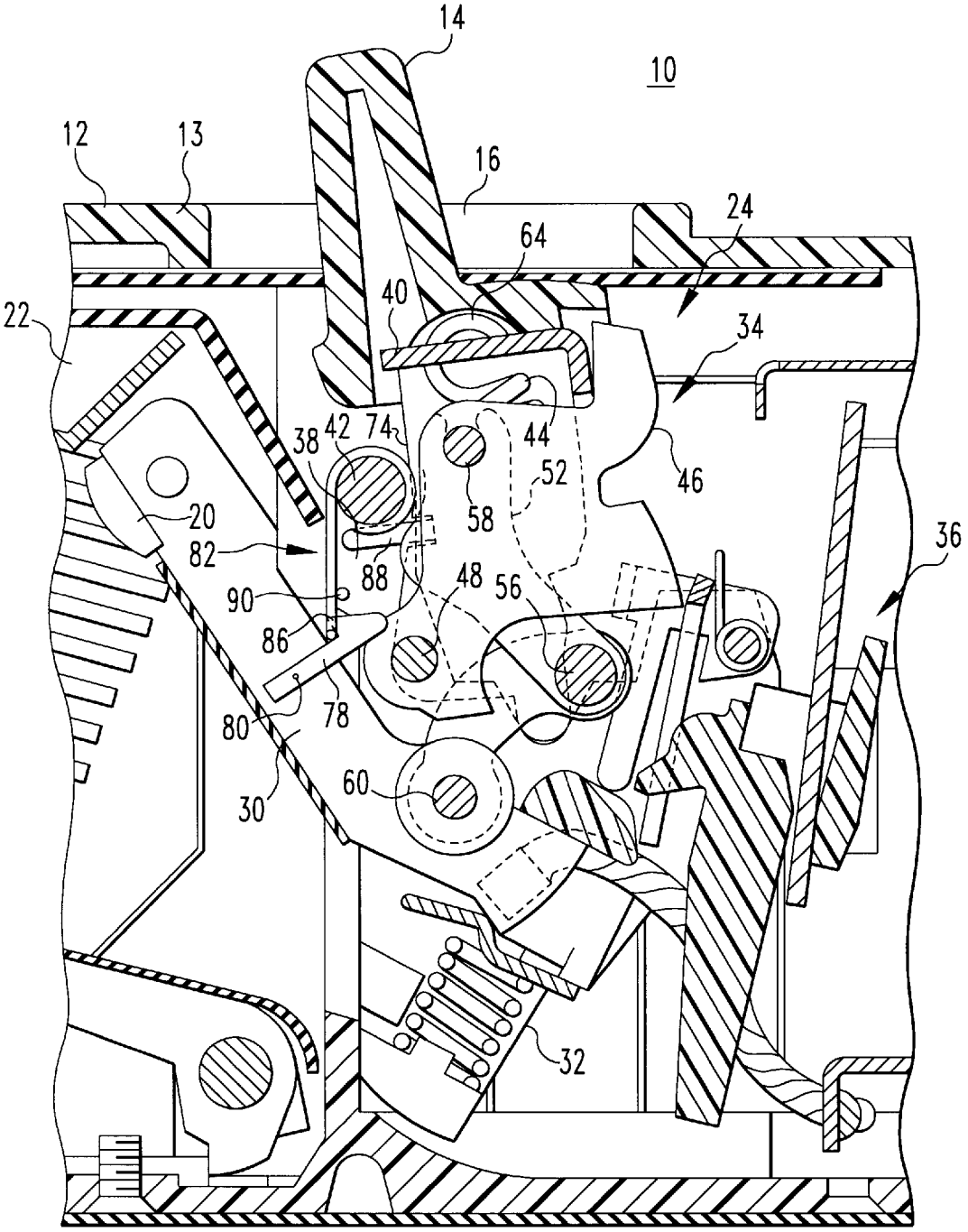
FIG. 3 is a partial sectional view similar to FIGS. 1 and 2 showing the circuit breaker in the tripped position.

Referring to the drawings and initially to FIGS. 1–3, there is set forth a circuit breaker 10 constructed in accordance with the principles of the present invention. It should be appreciated that while the invention is described with reference to the center pole of a three pole circuit breaker, the principles of the present invention disclosed herein are equally applicable to the other poles of the circuit breaker, or to a single phase or other polyphase circuit breakers.

The circuit breaker 10 includes a molded, electrically insulating housing 12. The circuit breaker 10 further includes an operating handle 14 extending through an opening 16 in the top surface 13 of molded housing 12 for setting the circuit breaker 10 to a closed position (FIG. 1) or to an open position (FIG. 2). The circuit breaker 10 also may assume a tripped position (FIG. 3) or a blown-open position (not shown). Subsequently to being placed in the tripped position, the circuit breaker 10 may be reset for further protective operation by moving the handle 14 past its open position. The handle 14 may then be left in its open position or moved to its closed position, in which case the circuit breaker 10 is ready for further protective operation. As is generally known, the movement of the handle 14 may be achieved either manually or automatically by a motor operator.

As is known, the circuit breaker 10 generally includes a set of separable contacts, namely a fixed contact 18 and a movable contact 20, an electrical arc chute 22, and an operating mechanism generally designated by reference numeral 24. The arc chute 22 is conventional and generally shown, and thus is not discussed in detail herein. As is also known, line terminal 26 is provided for receiving an electrical current from outside the molded housing 12 of circuit breaker 10 and establishing a current path, when the circuit breaker 10 is in the closed position (FIG. 1), which extends through the fixed contact 18 and the movable contact 20 and eventually leading to a load terminal 27.

The movable contact 20 is carried by a movable contact support assembly, generally designated by reference numeral 28. The movable contact support assembly 28 includes a movable contact arm 30 to which the movable contact 20 is fixed adjacent a first end thereof. The movable contact support assembly 28 further includes a means for pivotally supporting the movable contact arm 30 adjacent a second end thereof. This means for pivotally supporting the movable contact arm preferably includes a one-piece molded cross bar 32, as is generally known in the art. As is also well known, the operating mechanism 24 is operatively connected to the movable contact support assembly 28 so as to provide for rotation of the movable contact support assembly 28 between a closed position in which the fixed contact 18 and movable contact 20 are closed (FIG. 1) to conduct current and an open position (FIG. 2) in which the fixed contact 18 and movable contact 20 are open to interrupt current flow.

The operating mechanism 24 generally includes: an over-center toggle mechanism 34; a trip mechanism generally designated by reference numeral 36 (the trip mechanism 36 not being described in detail herein, rather a complete description may be found in the previously incorporated by reference U.S. Pat. No. 4,540,961); a pair of rigid, opposed or spaced apart side plates 38; a rigid, pivotable, handle yoke 40; a rigid stop pin 42; and at least one operating tension spring 44.

The over center toggle mechanism 34 includes a cradle 46 that is rotatable about the longitudinal central axis of a cradle support pin 48. The opposing ends of the cradle support pin 48, in an assembled condition, are retained in a pair of apertures 50 formed through the side plates 38 (see FIG. 4).

The over center toggle mechanism 34 further includes a pair of upper toggle links 52 (only one shown), a pair of lower toggle links 54 (only one shown), a toggle spring pin 56, and an upper toggle link follower pin 58. The lower toggle link 54 is secured to the movable contact arm 30 by a toggle contact pin 60 that allows the movable contact arm 30 to rotate with respect to the lower toggle link 54. The opposing ends of the toggle contact pin 60 are received and retained in the molded cross bar 32. Accordingly, movement of the movable contact arm 30 and the corresponding movement of the cross bar 32 is effected by movement of the lower toggle link 54. As can be appreciated and as is generally known, movement of the movable contact arm 30 by the operating mechanism 24 through the molded cross bar 32 allows for the fixed contact 18 and movable contact 20 to be moved between the closed position (FIG. 1) and the open position (FIG. 2).

Figure 4:
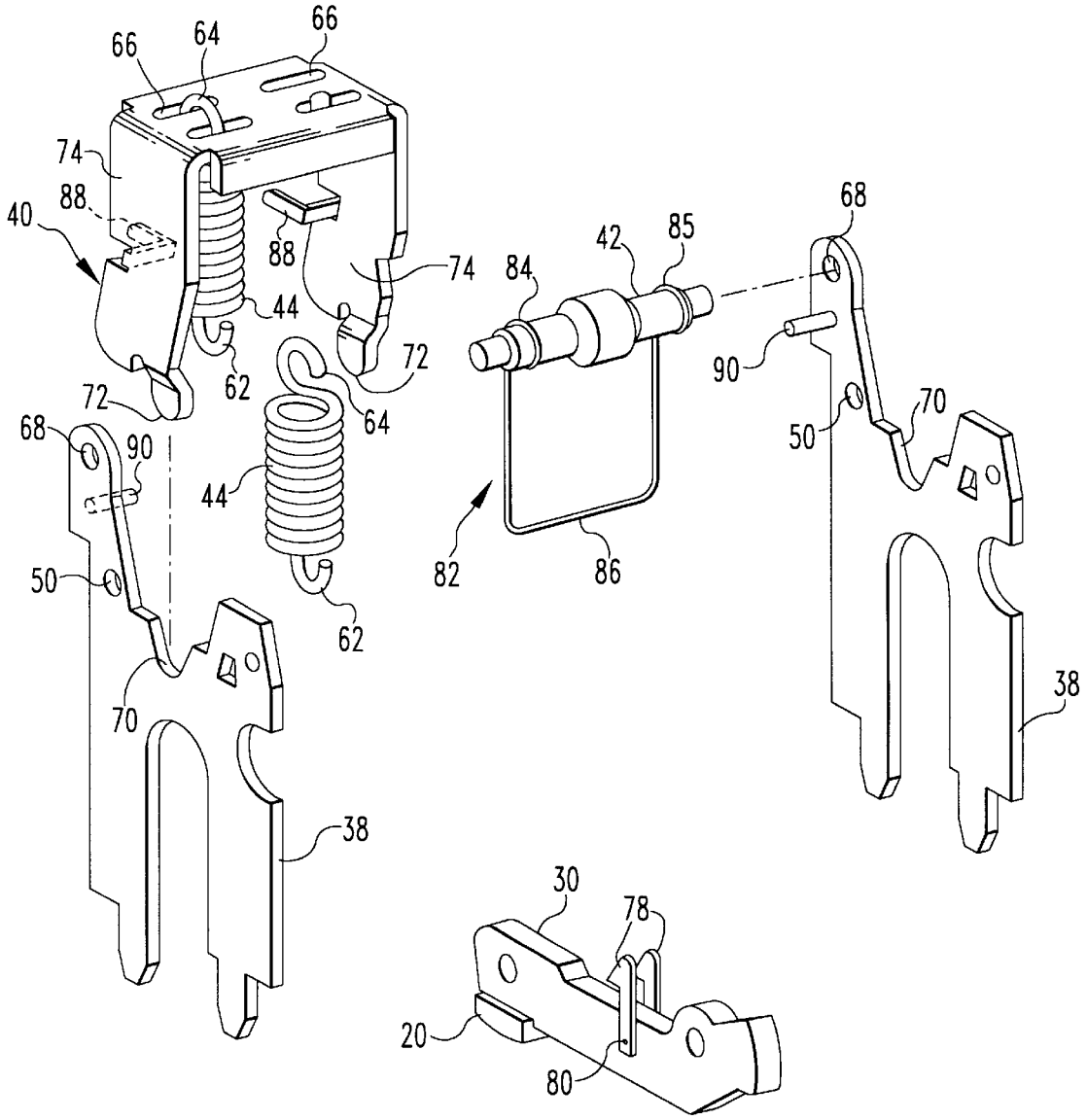
FIG. 4 is an exploded isometric view of selected components of the circuit breaker.

The upper toggle link 52 and lower toggle link 54 are interconnected by the toggle spring pin 56 allowing for rotational movement therebetween. As is generally known for over center toggle mechanisms of the type described herein, and described in more detail in the incorporated by reference U.S. Pat. No. 4,540,961, the ends of toggle spring pin 56 include journals (not shown) for the receipt and retention of the lower, hooked ends 62 of the operating tension spring 44, as shown in FIG. 4. In addition, the upper, hooked ends 64 are received through and retained in slots 66 formed through an upper surface of the handle yoke 40. In an assembled condition, the disposition of the curved ends 64 within the slots 66 and the disposition of the curved ends 62 in the journals of toggle spring pin 56 retain the upper toggle link 52 and lower toggle link 54 in engagement with the toggle spring pin 56 and also maintain the operating spring 44 under tension, enabling the operation of the over center toggle mechanism 34 to be controlled by and responsive to external movements of the operating handle 14.

With further reference to FIG. 4, the side plates 38 further include apertures 68 for receipt and retention of the opposite ends of the stop pin 42. In addition, bearing or pivot surfaces 70 are formed along the upper portion of the side plates 38 for engagement with a pair of bearing surfaces or round tabs 72 formed at the lower most portion of the downwardly depending support arms 74 of the handle yoke 40. The handle yoke 40 is thus controllably pivotal about the bearing surfaces 72 and 70.

As is generally known for circuit breakers of the type described herein, the movable contact arm 30 may be rotated from a closed position (FIG. 1) to either an open position (FIG. 2) or a tripped position (FIG. 3). From the tripped position (FIG. 3) the circuit breaker 10 may be reset for further protective operation by moving the handle 14 from its tripped position past its open position at which point the circuit breaker 10 may be left in the open position until desirable to place the circuit breaker 10 into its closed position (FIG. 1) for further protective operation.

Placement of the circuit breaker 10 into its closed operating position is achieved by manually or otherwise operating the operating handle 14 from the position shown in FIG. 3 to the position shown in FIG. 1. Of particular importance to the principles of the present invention and as is generally known for over center toggle mechanisms, the operating tension spring 44 moves from a first line of action located to the right of pin 58 (FIG. 3), over a center position to a second line of action located to the left of pin 58 (FIG. 1) as a result of movement of the operating handle 14. As the operating tension spring 44 moves from the first line of action to the second line of action, the stored energy contained in the operating tension spring 44 causes movement of the upper toggle link 52 and lower toggle link 54 resulting in the movable contact arm assembly 28, and necessarily contact arm 30, moving from the open position (FIG. 3) to the closed position (FIG. 1). It is important that sufficient energy be built up in and stored in the operating tension spring 44 when moving from the first line of action to the second line of action to be able to overcome the friction and resistance in the several components of the operating mechanism 24, and particularly the components of the over center toggle mechanism 34, during the closing operation. In addition, it is important that the movable contact arm 30 be quickly or rapidly closed to ensure that fixed contact 18 and movable contact 20 are brought into engagement to establish current flow through the circuit breaker 10. The rapid closing of the movable contact arm 30 may be necessary, for example, to overcome repulsion forces or prevent arcing when attempting to close on a current.

When attempting to place the circuit breaker 10 in the closed position, operation of the operating handle 14 too slowly may result in a problem commonly identified in the art as "sneak". Sneak results from the operating handle 14 being operated too slowly. This in turn prevents the movable contact arm 30 from being rotated in a manner to rapidly close the fixed contact 18 and movable contact 20 to initiate current flow through the circuit breaker 10.

In accordance with an important aspect of the present invention, a releasable retaining mechanism is provided for quickly closing the movable contact arm 30 of the circuit breaker 10 to prevent sneak during movement of the movable contact arm 30 to the closed position.

With reference to a preferred embodiment set forth in FIGS. 1–4, the releasable retaining mechanism includes at least one hook member 78 rigidly secured to the movable contact arm 30, such as by rivet 80 or other suitable means as may be known. The releasable retaining mechanism further includes a retaining spring 82 mounted or secured to the operating mechanism 24 of the circuit breaker 10. Preferably, the retaining spring 82 includes first and second ends 84, 85 which are mounted to opposing ends of the stop pin 42 adjacent the spaced apart side plates 38. The retaining spring 82 also includes a U-shaped portion 86 extending generally downwardly from the stop pin 42. As shown in FIGS. 2 and 3, the hook member 78 engages the U-shaped portion 86 of latch spring 82 when the movable contact arm 30 is in the open or tripped position.

The releasable retaining mechanism further includes at least one release finger 88 (only one shown) extending from the operating mechanism 24, and preferably extending from the support arms 74 of the handle yoke 40. The release finger 88 is provided for contacting the retaining spring 82 when the operating handle 14 is setting the movable contact support arm 30 to the closed position so as to release the hook member 78 from engagement with the retaining spring 82, as will be described in more detail herein. As shown in FIG. 4, the release finger 88 is preferably integrally formed with the support arms 74. Release finger 88 is also preferably L-shaped in order to provide clearance around the side plates 38 when handle yoke 40 is pivoted to the closed position by handle 14.

FIG. 1 shows the circuit breaker 10 in the closed position. While in the closed position, the release finger 88 is in contact with the U-shaped portion 86 of retaining spring 82. Upon the occurrence of a tripping operation or movement of the operating handle 14 to the open position, the release finger 88 moves in a counter clockwise direction along with the handle yoke 40. This results in the retaining spring 82 rotating in a counter clockwise direction and rotating to an essentially vertical position (with respect to the top surface 13 of circuit breaker 10). Movement of the retaining spring 82 in a counter clockwise direction past the essentially vertical position is limited by stop tabs 90 (only one shown) which are mounted to the side plates 38. As the movable contact arm 30 continues to rotate to the open position, the hook member 78 approaches and begins to contact the U-shaped portion of now vertically oriented retaining spring 82.

Figure 5A:
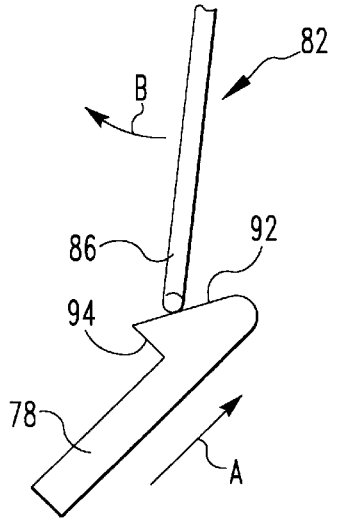
FIG. 5*a* is a simplified side view showing the cooperation between the hook member and retaining spring during rotation of a movable contact arm of the circuit breaker to the open position.
Figure 5B:
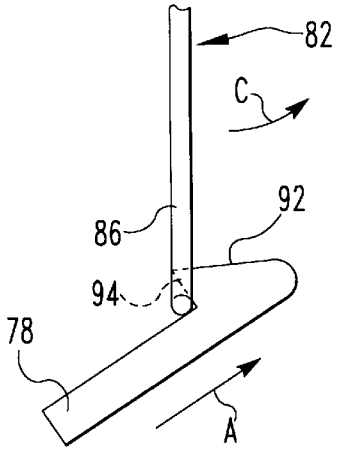
FIG. 5*b* is a simplified side view, similar to FIG. 5*a*, showing the cooperation between the hook member and retaining spring once the movable contact arm is in the fully open position.

With reference to FIGS. 5*a* and 5*b*, the cooperation between the hook member 78 and the retaining spring 82 is shown. Specifically, as the hook member 78 moves generally upwardly to the open position, as indicated by arrow A, camming surface 92 comes into contact with the U-shaped portion 86 of the retaining spring 82 and displaces the retaining spring 82 in a clockwise direction, as indicated by arrow B. As the hook member 78 continues to the open position, the U-shaped portion 86 of retaining spring 82 eventually clears the camming surface 92. Then hooking surface 94 comes into engagement with the U-shaped portion 86 of retaining spring 82 once the movable contact arm 30 is in the fully open position. As shown in FIG. 5*b*, the retaining spring 82 rotates in a counter clockwise direction, as indicated by arrow C in order for the U-shaped portion 86 to come into engagement with the hooking surface 94.

Advantageously, the positive engagement which is achieved by the cooperation between the hook member 78 and the retaining spring 82 advantageously overcomes another problem commonly associated with circuit breakers of the type described herein, namely the problem of "bounce". Bounce occurs as a result of the rapid rotation of the movable contact arm 30 during opening of the fixed contact 18 and movable contact 20. Bounce may occur during either an automatic tripping operation or while maneuvering the operating handle 14 to open the fixed contact 18 and movable contact 20. The positive engagement between the hook member 78, which is rigidly secured to the movable contact arm 30 as described herein, and the retaining spring 82 prevents the movable contact arm 30 from attempting to return or bounce to the closed position.

When operating the circuit breaker 10 from the open position (FIG. 3) to the closed position (FIG. 1), it is desirable to avoid the problem of sneak, as discussed herein above. Advantageously, the problem of sneak is overcome by the present invention as a result of employing the releasable retaining mechanism. Specifically, when the operating handle 14 is moved to the closed position, the operating tension spring 44 is moved from the first line of action to the second line of action with the energy that is stored during this movement of the operating tension spring 44 being the driving force for rotating the movable contact support assembly 28, and specifically for rotating the movable contact arm 30, to the closed position. In order to assure that sufficient energy is maintained in the operating tension spring 44 for rapidly rotating the movable contact arm 30, the hook member 78 remains in engagement with the U-shaped portion 86 of the latch spring 82 until such time as the operating tension spring 44 reaches the second line of action.

The continued engagement between the hook member 78 and the retaining spring 82 prevents the movement of contact arm 30 which in turn prevents the movement of lower toggle link 54. Upper toggle link 52, which is connected by pin 56 to lower toggle link 54, is also prevented from moving to the closed position. Meanwhile, the continued operation of operating handle 14 to the closed position results in the continued expansion of operating tension spring 44 due to lower, hooked ends 62 being connected to the pin 56 which is not allowed to move as long as hook member 78 remains in engagement with retaining spring 82. The operating tension spring 44 thus continues to stretch and expand as it moves over-center and approaches the second line of action. Once the release finger 88 engages the U-shaped portion 86 of retaining spring 82 and rotates the retaining spring 82 in the clockwise direction thus releasing the U-shaped portion 86 from engagement with the hooking surface 94 of the hook member 78, it can be appreciated that all of the energy that has been built up and stored in the operating tension spring 44 during movement of the operating tension spring 44 from the first line of action to the second line of action is immediately applied through the over center toggle mechanism 34 to the movable contact arm support assembly. More specifically, the disengagement of hook member 78 from the U-shaped portion 86 of retaining spring 82 results in the contact arm 30 being rapidly or quickly rotated to the closed position due to the overly expanded operating tension spring 44 now being able to release some of its energy and pull against pin 56. This allows the lower toggle link 54 to move to the closed position which further allows for movable contact arm 30 to be rotated to the closed position (FIG. 1) due to pin 60 interconnecting movable contact arm 30 and lower toggle link 54.

Figure 6:
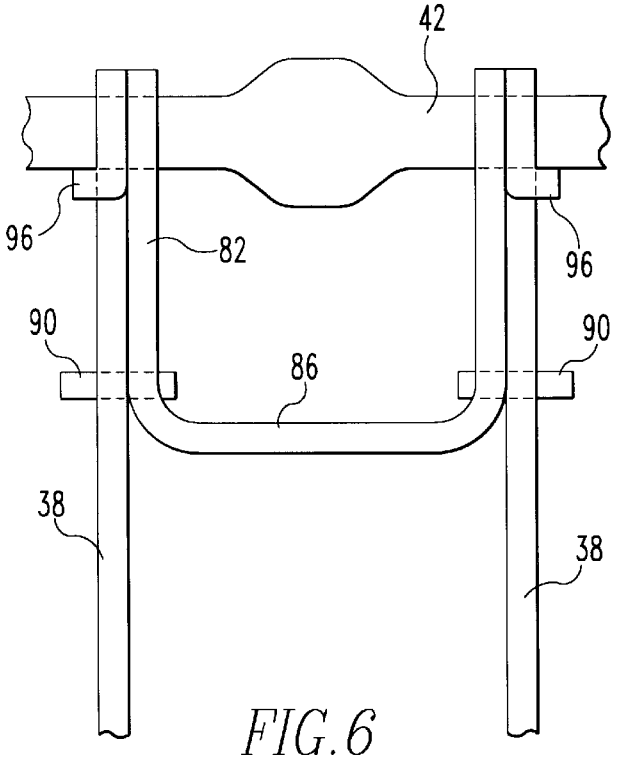
FIG. 6 is a front view, with parts removed for simplicity, of a portion of the releasable retaining mechanism of the invention.

FIG. 6 further illustrates the mounting of the retaining spring 82 to the stop pin 42. Specifically, the retaining spring 82, which is preferably composed of spring steel, includes, outwardly extending projections 96 which engage the side plates 38 so as to securely retain the retaining spring 82 in position and provide the biasing spring action of retaining spring 82.

Figure 7:
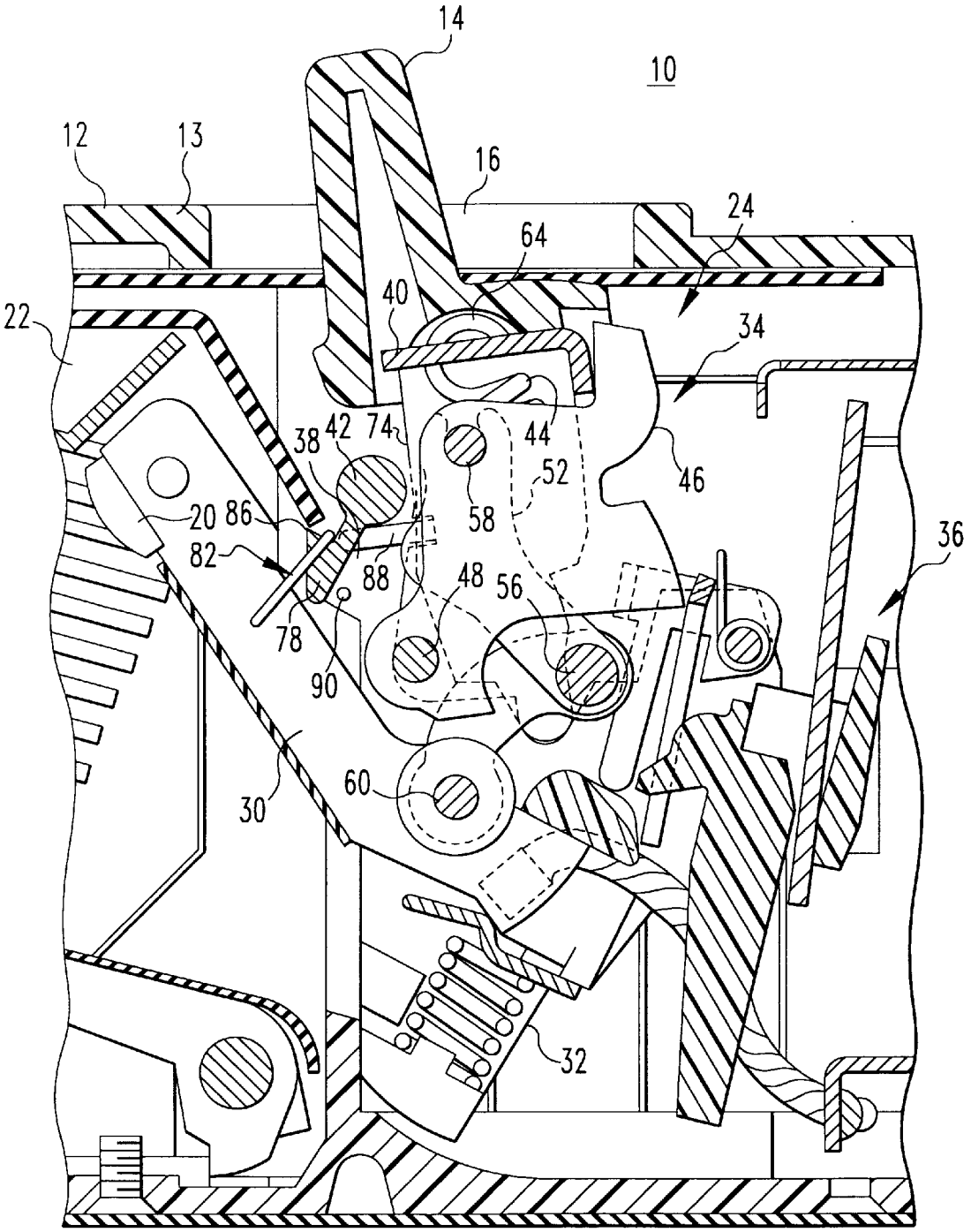
FIG. 7 is a partial sectional view, similar to FIG. 3, showing another embodiment of the invention.

While specific embodiments of the invention have been described in detail, it will be appreciated by those skilled in the art that various modifications and alternatives to those details could be developed in light of the overall teachings of the disclosure. For example, the described positioning of the hook member 78 being secured to movable contact arm 30 and the retaining spring 82 being secured or mounted to the operating mechanism 34 could be reversed (see FIG. 7) and essentially the same result of preventing "sneak" and/or "bounce" could be achieved. Accordingly, the particular arrangements disclosed are meant to be illustrative only and not limiting as to the scope of invention which is to be given the full breadth of the claims appended and any and all equivalents thereof.

What is claimed is:

1. A circuit breaker comprising:

separable contacts comprising a fixed contact and a movable contact;

a movable contact support assembly including a movable contact arm to which said movable contact is fixed adjacent a first end, and means pivotally supporting said movable contact arm adjacent a second end;

an operating mechanism operatively connected to said movable contact support assembly to rotate said movable contact support assembly between a closed position in which said separable contacts are closed to conduct current and an open position in which said separable contacts are open to interrupt current;

an operating handle for actuating said operating mechanism and setting said movable contact support assembly to said closed position and said open position; and releasable retaining means for retaining said movable contact arm when said movable contact support assembly is in said open position and for releasing said movable contact arm when said operating handle reaches said closed position, said releasable retaining means comprising:

at least one hook member rigidly secured to one of said movable contact arm and said operating mechanism;

a retaining spring secured to the other of said movable contact arm and said operating mechanism, said at least one hook member engaging said retaining spring when said movable contact support assembly is in said open position; and at least one release finger extending from said operating mechanism, said at least one release finger contacting one of said retaining spring and said at least one hook member that is secured to said operating mechanism when said operating handle reaches said closed position so as to release said at least one hook member from engagement with said retaining spring.

2. The circuit breaker of claim 1 wherein said operating mechanism includes a pair of spaced apart side plates and a rigid stop pin having opposing ends mounted to said spaced apart side plates, said retaining spring mounted to said rigid stop pin.

3. The circuit breaker of claim 2 wherein said retaining spring includes a first and second end, said first and second ends mounted to said opposing ends of said rigid stop pin adjacent said spaced apart side plates, said retaining spring further including a U-shaped portion depending generally downwardly from said rigid stop pin, said at least one hook member engaging said U-shaped portion when said movable contact support assembly is in said open position.

4. The circuit breaker of claim 3 wherein said at least one hook member includes a camming surface and a hooking surface adjacent said camming surface, said camming surface displacing said U-shaped portion of said retaining spring in a first direction during rotation of said movable contact support assembly to said open position, and said hooking surface engaging said U-shaped portion once said movable contact support assembly is in said open position.

5. The circuit breaker of claim 4 wherein said operating mechanism further includes a handle yoke in cooperation with said operating handle, said handle yoke including a pair of spaced apart support arms in cooperation with said spaced apart side plates, said at least one release finger extending from one of said spaced apart support arms and positioned so as to contact and move said U-shaped portion of said retaining spring in said first direction when said operating handle reaches said closed position so as to release said at least one hook member from engagement with said retaining spring.

6. The circuit breaker of claim 5 further including blocking means for blocking movement of said retaining spring in a second direction, said second direction opposite to said first direction, said blocking means extending from one of said spaced apart side plates.

7. The circuit breaker of claim 1 wherein said operating mechanism includes an over-center toggle mechanism having at least one operating tension spring, said at least one operating tension spring moving from a first line of action to a second line of action when said operating handle is setting said movable contact support assembly to said closed position, said at least one release finger contacting said retaining spring once said at least one operating tension spring approaches said second line of action.

8. A circuit breaker comprising:

separable contacts comprising a fixed contact and a movable contact;

a movable contact support assembly including a movable contact arm to which said movable contact is fixed adjacent a first end, and means pivotally supporting said movable contact arm adjacent a second end;

an operating mechanism operatively connected to said movable contact support assembly to rotate said movable contact support assembly between a closed position in which said separable contacts are closed to conduct current and an open position in which said separable contacts are open to interrupt current;

an operating handle for actuating said operating mechanism and setting said movable contact support assembly to said closed position and said open position;

releasable retaining means for retaining said movable contact arm when said movable contact support assembly is in said open position and for releasing said movable contact arm when said operating handle reaches said closed position, and said operating mechanism including an over-center toggle mechanism having at least one operating tension spring, said at least one operating tension spring moving from a first line of action to a second line of action when said operating handle is setting said movable contact support assembly to said closed position, said releasable retaining means releasing said movable contact arm once said at least one operating tension spring approaches said second line of action.

* * * * *